US005722875A

United States Patent [19]

Iwashita et al.

[11] Patent Number: 5,722,875

[45] Date of Patent: Mar. 3, 1998

[54] METHOD AND APPARATUS FOR POLISHING

[75] Inventors: Mitsuaki Iwashita, Nirasaki; Nobuo Konishi, Yamanashi-ken, both of Japan; Gerald A. Krulik, San Clementa, Calif.; Gary Cohrt, Gilbert, Ariz.

[73] Assignees: Tokyo Electron Limited, Tokyo, Japan; IPEC-Planar, Phoenix, Ariz.

[21] Appl. No.: 655,672

[22] Filed: May 30, 1996

[30] Foreign Application Priority Data

May 30, 1995 [JP] Japan ..... 7-155402
May 30, 1995 [JP] Japan ..... 7-155403

[51] Int. Cl.[6] ..... B24B 49/00; B24B 51/00

[52] U.S. Cl. ..... 451/8; 451/288

[58] Field of Search ..... 451/1, 5, 8, 7, 451/6, 41, 285, 286, 287, 288, 289

[56] References Cited

U.S. PATENT DOCUMENTS

| | | | |
|---|---|---|---|
| 5,036,015 | 7/1991 | Sandhu et al. | 451/41 |
| 5,069,002 | 12/1991 | Sandhu et al. | 451/41 |
| 5,081,796 | 1/1992 | Schultz | 451/41 |
| 5,104,828 | 4/1992 | Morimoto et al. | 451/7 |
| 5,191,738 | 3/1993 | Nakazato et al. | 451/289 |
| 5,308,438 | 5/1994 | Cote et al. | 451/41 |
| 5,433,650 | 7/1995 | Winebarger | 451/6 |
| 5,433,651 | 7/1995 | Lustig et al. | 451/6 |
| 5,597,442 | 1/1997 | Chen et al. | 451/7 |
| 5,609,511 | 3/1997 | Moriyama et al. | 451/8 |

FOREIGN PATENT DOCUMENTS

| | | |
|---|---|---|
| 58-178526 | 10/1983 | Japan . |
| 7-24708 | 1/1995 | Japan . |
| 7-94452 | 4/1995 | Japan . |

*Primary Examiner*—James G. Smith
*Assistant Examiner*—Derris H. Banks
*Attorney, Agent, or Firm*—Oblon, Spivak, McClelland, Maier & Neustadt, P.C.

[57] ABSTRACT

The invention relates to a method and an apparatus for polishing an object by CMP with use of a polishing liquid. A change point of the temperature of a surface-to-be-polished of the object at the time of polishing is detected on the basis of information on the temperature of the surface-to-be-polished of the object, which information is obtained in advance at the time of polishing. An end point of the polishing of the object is detected on the basis of information on the change point. The object and a reference object are interlocked and simultaneously polished by a common polishing body, the degree-of-polishing of the reference object is monitored, and the degree-of-polishing of the object is detected on the basis of the degree-of-polishing of the reference object.

17 Claims, 4 Drawing Sheets

METHOD AND APPARATUS FOR POLISHING

BACKGROUND OF THE INVENTION

1. Field of the Invention

The present invention relates to a method and an apparatus for polishing.

2. Description of the Related Art

Processes for manufacturing semiconductor wafers (hereinafter referred to as "wafers") include a polishing process called CMP (Chemical Mechanical Polishing). In the CMP process, while a polishing agent consisting mainly of silica ($SiO_2$) is being supplied onto the surface of a polishing cloth formed of, e.g. polyurethane attached to a rotary table 1, a wafer or an object-to-be polished is polished. Although the polishing mechanism in the CMP is not clarified, it is generally considered that a synergetic effect of chemical and mechanical mechanisms is closely related to the polishing mechanism.

The CMP is applied to an etch-back step, e.g. a step of etching away an unnecessary portion of a metallic film such as a W (tungsten) film or an Al (aluminum) film formed on an insulating film having a contact hole, thereby exposing the insulating film. The CMP is also applied to a step of polishing an interlayer formed on the entire surface of a wafer until the interlayer has a predetermined thickness, a step of forming buried wiring, a step of forming a buried plug, etc.

FIG. 1 schematically shows a conventional apparatus for performing CMP. In FIG. 1, numeral 1 denotes a rotary table which can be rotated by a motor, etc. A polishing cloth 2 is attached on the surface of the rotary table 1. A wafer holding member 4 for holding a wafer 3 is disposed above the rotary table 1 such that a surface-to-be-polished of the wafer 3 is opposed to the polishing cloth 2. The wafer holding member 4 can be vertically moved by vertical movement means (not shown). When a polishing process is performed, the wafer holding member 4 is lowered and the wafer 3 is pressed on the polishing cloth 2 under a predetermined pressure. A motor 5 is coupled to the wafer holding member 4 to rotate the wafer holding member 4. A nozzle 6 for supplying a polishing liquid on the polishing cloth 2 is disposed above a central area of the rotary table 1.

In the apparatus with the above structure, the wafer holding member 4 is lowered and the wafer 3 is pressed on the polishing cloth 2 under a predetermined pressure. The rotary table 1 is rotated and the wafer holding member 4 is also rotated by the motor 5. Thereby, the wafer 3 rotates about its own axis while revolting relative to the rotary table 1. In this state, while the polishing liquid is being supplied from the nozzle 6 onto the polishing cloth 2, the polishing process is performed.

In the prior art, a torque current of the motor 5 for rotating the wafer holing member 4 is monitored to detect the end point of the CMP, i.e. the time point at which, for example, a TiN film (barrier layer) and a metal film formed on an insulating film have been polished away and the surface of the insulating film has been exposed. Specifically, the end point of the CMP is detected by sensing a variation in torque current by making use of the fact that the friction between the object-to-be-polished and the polishing cloth varies depending on the material of the object-to-be-polished and the fact that there is a difference in torque between the time of polishing the metallic film and the time of polishing the insulating film.

On the other hand, when an object is polished by a predetermined thickness, as in the case of polishing an interlayer insulating film, the above-mentioned method of sensing a variation in torque current of the motor is not applicable. Thus, for example, the rate of polishing the object-to-be-polished is found in advance, and the degree of polishing is controlled by managing the polishing time.

In the method of detecting a torque current, however, a variation in torque current is small and there is much noise. Consequently, it is not possible to detect the end point of the CMP with high precision. To solve this problem in the prior art, while the torque current is varying, the motor 5 is stopped a little before, e.g. an estimated end point of the CMP, and the wafer holding member 4 is raised. Then, the operator observes the surface of the wafer 3 by the naked eye, thereby to determine whether the film to be polished, e.g. an insulating film, has completely been exposed. If further polishing is necessary, the degree of further necessary polishing is estimated by rule of thumb. In the method of detecting the torque current, as mentioned above, the variation in torque current is, in fact, referred to in order to generally determine the end point of the CMP, and the actual end point is determined by the naked eye of the operator. Consequently, the end point is not detected with high detection and the work load on the operator increases.

In the method of polishing the object by a predetermined thickness by monitoring the polishing time, the polishing rate varies depending on the surface condition of the polishing cloth. Thus, the polishing rate with use of a new polishing cloth slightly differs from that with use of an old polishing cloth, and it is difficult to precisely control the amount of polishing (i.e. film thickness) of the object. In particular, the quality of the polishing cloth is degraded, the amount of polishing differs from a predetermined value. It is necessary, therefore, to regularly check the polishing rate.

SUMMARY OF THE INVENTION

The present invention has been made in consideration of the above circumstances, and the object thereof is to provide a polishing method and a polishing apparatus wherein the amount of polishing can be exactly and easily controlled and an end point of polishing can be easily detected.

According to a first aspect of the invention, there is provided a method of polishing an object by CMP with use of a polishing liquid, said object including a first layer and a second layer of a material different from the material of the first layer, said method comprising the steps of:

detecting a change point of the temperature of a surface-to-be-polished of the first layer while said first layer is being polished, on the basis of an information unit on the temperature of the surface-to-be-polished of the first layer and an information unit on the temperature of a surface-to-be-polished of the second layer, which information units are obtained by polishing in advance said first and second layers; and detecting an end point of the polishing of the first layer on the basis of information on the change point.

According to a second aspect of the invention, there is provided a method of polishing an object by CMP with use of a polishing liquid, said method comprising the steps of:

simultaneously polishing said object and a reference object by a common polishing body in an interlocking manner; and continuously monitoring the degree of polishing of the reference object, and finding the degree of polishing of the object on the basis of the degree of polishing of the reference object.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Embodiments of the present invention will now be described with reference to the accompanying drawings.

(Embodiment 1)

Figure 1:
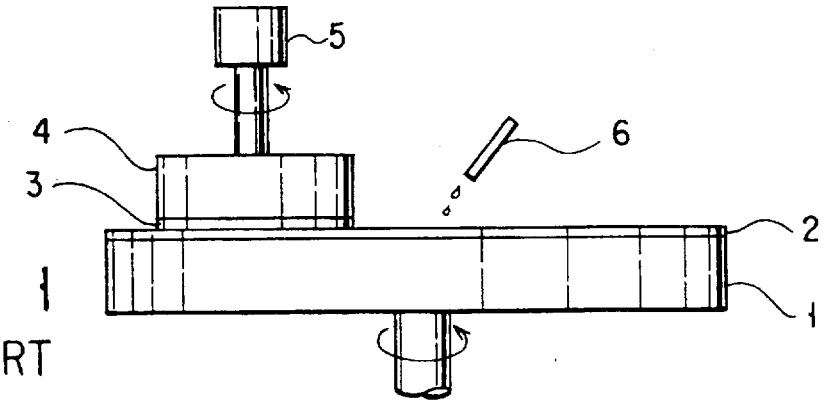
FIG. 1 PRIOR ART
FIG. 1 is a schematic view showing a conventional polishing apparatus.
Figure 2:
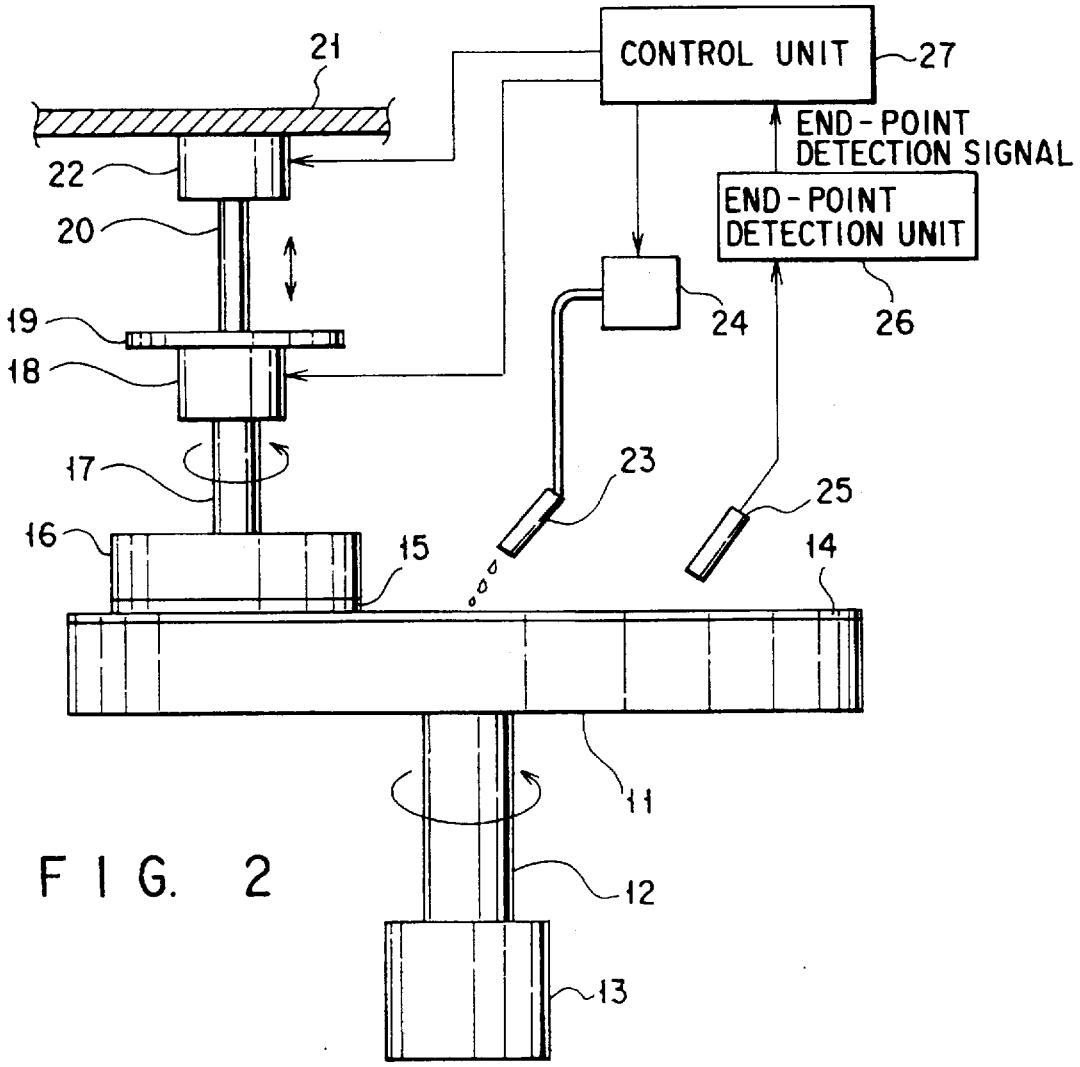
FIG. 2 shows the structure of a polishing apparatus according to a first aspect of the invention.
Figure 3:
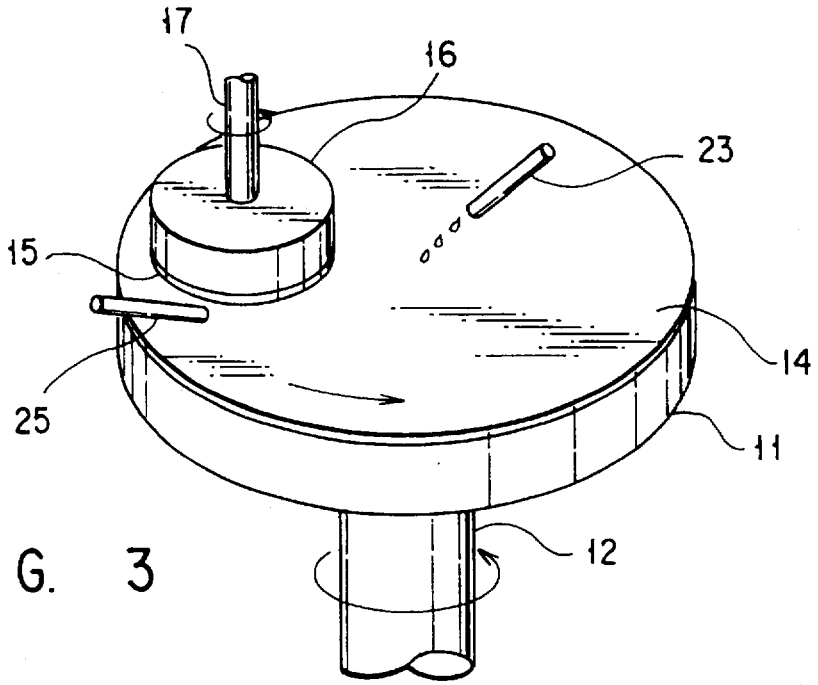
FIG. 3 shows a main part of the polishing apparatus according to the first aspect of the invention.

FIG. 2 shows the structure of a polishing apparatus according to a first aspect of the invention, and FIG. 3 is a perspective view showing a main part of the polishing apparatus according to the first aspect of the invention. In the figures, reference numeral 11 denotes a rotary table. One end portion of a rotary shaft 12 is attached to a central portion of the rotary table 11, and the other end portion of the rotary shaft 12 is attached to a motor 13. The rotary shaft 12 is driven by the motor 13 to rotate the rotary table 11. A polishing cloth 14 formed of, e.g. polyurethane is attached on the rotary table 11.

A wafer holding member 16 is situated in a position above the rotary table 11 at a distance from a central portion of the rotary table 11. The wafer holding member 16 holds a wafer 15 or an object to be polished (hereinafter referred to as "object"), such that the surface-to-be-polished of the wafer 15 faces the polishing cloth 14 substantially in parallel. The wafer holding member 16 has a vacuum chuck mechanism (not shown) for holding the wafer 15. One end portion of a rotary shaft 17 is attached to the upper surface of the wafer holding member 16, and the other end portion of the rotary shaft 17 is attached to a motor 18. The rotary shaft 17 is driven by the motor 18 to rotate the wafer holding member 16.

The motor 18 is attached to a vertical drive member 19. The vertical drive member 19 is coupled to a vertical drive mechanism 22 via a vertical drive shaft 20. The vertical drive mechanism 22 is attached to a fixed plate 21. The vertical drive member 19 is vertically moved by the vertical drive mechanism 22 via the drive shaft 20. Thus, the wafer 15 can be pressed on and separated from the polishing cloth 14. The vertical drive mechanism may comprises an air cylinder or a ball-screw mechanism.

A polishing liquid supply nozzle 23 is situated above the central portion of the rotary table 11. The polishing liquid supply nozzle 23 communicates with a polishing liquid supply source 24 via a pipe. The polishing liquid supply source 24 contains a polishing liquid, e.g. colloidal silica which is an alkalescent slurry consisting mainly of silica. If the polishing liquid is supplied from the supply source 24 onto a central portion of the polishing cloth 14 through the supply nozzle 23, the supplied polishing liquid is spread toward the outer edge of the polishing cloth 14 by centrifugal force produced by the rotation of the rotary table 11 and enters between the polishing cloth 14 and wafer 15. The CMP is thus effected on the object.

A temperature detector for detecting the surface temperature of the polishing cloth 14, e.g. an infrared temperature sensor 25, is provided above a surface portion of the polishing cloth 14 immediately on the downstream side of the wafer 15 (i.e. near the wafer 15) in the rotational direction of the polishing cloth 14. The sensor 25 senses the temperature of the polishing cloth 14 immediately after polishing. Specifically, the infrared temperature sensor 25 senses infrared radiated from the object to be sensed and detects the surface temperature of the object. The sensor 25 may be of a single wavelength type or a two-wavelength type. The infrared temperature sensor 25 is connected to an end-point detection unit 26. The end-point detection unit 26 compares temperature information obtained by the infrared temperature sensor 25 with preset temperature information, thereby determining whether the detected temperature is lower or higher than the preset temperature. The end-point detection unit 26 is connected to a control unit 27. When the end-point detection unit 26 has detected the end-point of polishing by the comparison of temperatures, the detection unit 26 outputs an end-point detection signal to the control unit 27.

The control unit 27 has functions of controlling the driving of the motors 13 and 18 and vertical movement mechanism 22 and controlling the supply/stop of the polishing liquid from the polishing liquid supply nozzle 23. Upon receiving the end-point detection signal, the control unit 27 stops the motors 13 and 18 and supplies a signal to the vertical drive mechanism 22 to raise the wafer holding member 16.

A description will now be given of a method of polishing a metallic film which is formed on the entire surface of a silicon oxide film having contact holes, with a barrier layer interposed therebetween, by means of CMP by using the polishing apparatus having the above structure. In this method, a phenomenon is utilized, in which the amount of heat produced during polishing a metallic film differs from that of heat produced during polishing a silicon oxide film, thereby detecting a time point at which the silicon oxide film has been exposed. Thus, a dummy wafer having the same film structure as the object is polished, and the surface temperature of the polishing cloth 14 during the polishing is measured, thus obtaining measurement data.

Figure 4A:
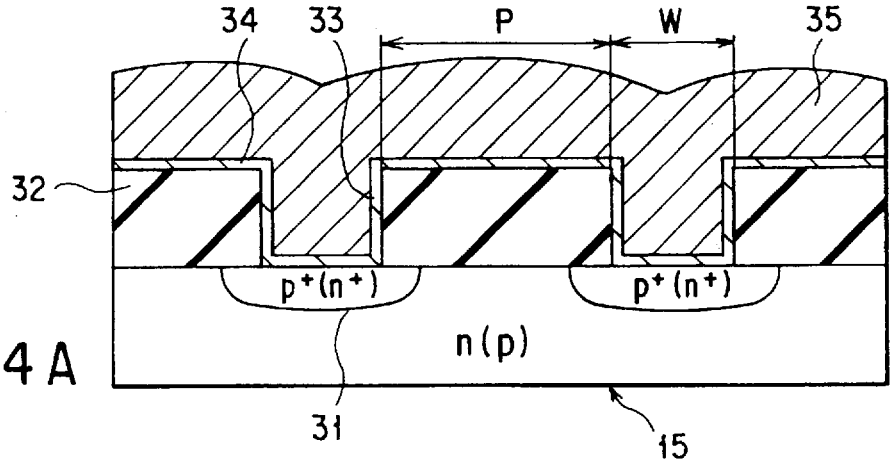
FIGS. 4A and 4B are cross sectional views showing an object-to-polished for use in the polishing method according to the first aspect of the invention.

FIG. 4A is a cross-sectional view showing an object for use in the polishing method of the present invention. In this object, $p^+$ type or $n^+$ type diffusion regions 31 are formed in a wafer 15 by means of ion implantation, etc. A silicon oxide film 32 or an insulating film is formed on the wafer 15. Grooves 33 each having a width of, e.g. 0.8 μm are formed in the silicon oxide film 32 such that the diffusion regions 31 are exposed. A TiN film 34 with a thickness of, e.g. 500 Å is formed as a barrier layer on the silicon oxide film 32 and on the walls of the grooves 33. A W film 35 or a metallic film is formed over the TiN film 34.

In the above object, a laminated structure of the W film 35 and TiN film 34 constitutes a first layer, and the silicon oxide film 32 constitutes a second layer. In the present invention, the barrier layer may not be provided, and the W film used as conductive film may be replaced with an Al film, a Cu film, or a laminated structure thereof. In addition, in the present invention, the silicon oxide film used as second layer may be replaced with a polysilicon film, or a laminated structure thereof. Furthermore, in the present invention, the first layer may be an insulating film such as a silicon oxide film, a silicon nitride film, or a laminated structure thereof, and the second layer may be an electrically conductive film such as a metallic film, a polysilicon film, or a laminated structure thereof. In this case, a polishing liquid, which has a greater selectivity of a polishing rate on the first layer than on the second layer, may be used. In addition, the wafer used as an object-to-be-polished or a substrate may be replaced with an LCD substrate (glass substrate). In consideration of polishing stopper effect, it is desirable that the ratio of a pitch P of grooves in the object to a width W of each of the grooves be 2 or more.

The object having the above film structure is mounted on the polishing apparatus and the polishing process is performed in the manner. The wafer holding member 16 is raised to a high position by the vertical drive mechanism 22, and the wafer 15 having a size of, e.g. 6 inches, is vacuum-attached to the wafer holding member 16 such that the surface-to-be-polished of the wafer 15 faces downward to the polishing cloth 14.

Figure 4B:
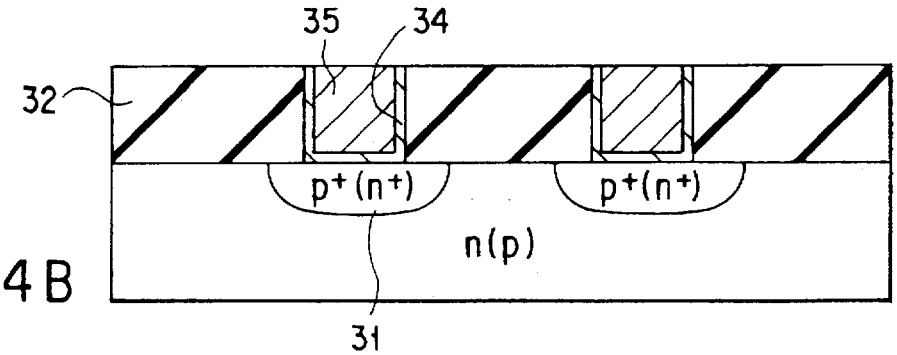

The wafer holding member 16 is then lowered by the vertical drive mechanism 22 while the wafer holding member 16 is being rotated and the rotary table 11 is being rotated. Thus, the wafer 15 is put in surface-contact with the polishing cloth 14 under a predetermined pressure. In this case, the wafer 15 rotates about its own axis and revolves relative to the rotary table 11. In addition, the polishing liquid is supplied onto the surface of the polishing cloth 14 from the polishing liquid supply nozzle 23. The W film 35 is polished by the friction among the W film 35 of the wafer 15, polishing cloth 14 and polishing liquid, the chemical reaction between the constituents of the polishing liquid and tungsten due to the frictional heat. As a result, as shown in FIG. 4B, the silicon oxide film 32 is exposed. In the present invention, it is desirable that the polishing pressure be 500 $g/cm^2$ or less. It is desirable that the rotational speed of each of the rotary table 11 and wafer holding member 16 be 20 to 80 rpm.

In this case, the end-point of polishing is determined in the following manner. When the object or W film (first layer) 35 is polished, the surface temperature of the polishing cloth 14 rises due to the friction between the W film 35 and polishing cloth 14 and the chemical reaction between the W film 35 and polishing liquid. While the W film 35 and TiN film 34 are polished and the silicon oxide film (second layer) is exposed, the mechanical and mechanical conditions vary. Accordingly, the surface temperature of the polishing cloth 14 varies, for example, lowers. For example, if the polishing liquid, which has a greater selectivity of a polishing rate on the W film (first layer) than on the silicon oxide film (second layer), is used, the chemical reaction between the polishing liquid and tungsten does not progress and the surface temperature of the polishing cloth 14 lowers. Accordingly, the surface temperature of the polishing cloth 14 is detected and the end-point of polishing is determined, for example, when the detected temperature has decreased below a temperature preset on the basis of previously acquired information of the surface temperature. After the W film 35 has been polished away, the TiN film 34 is polished. Since the TiN film 34 is very thin, it is shortly polished away, and the silicon oxide film is exposed, as shown in FIG. 4B.

Figure 5:
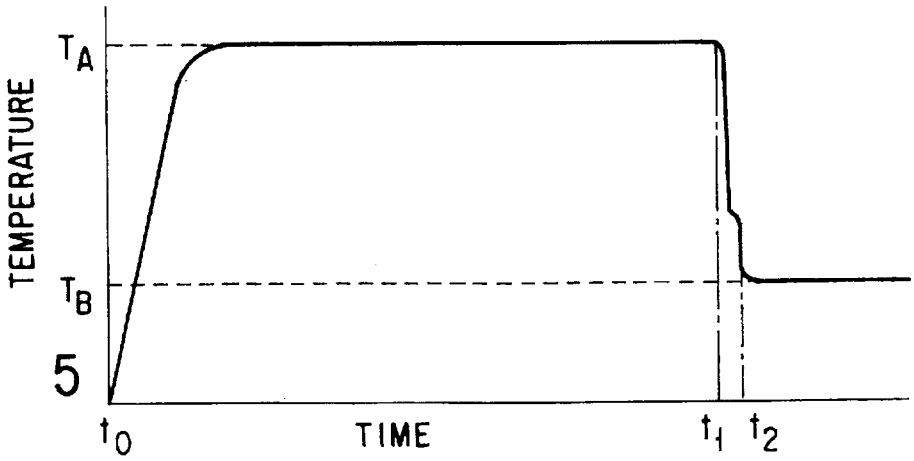
FIG. 5 is a characteristic diagram showing measured data of surface temperatures of a polishing cloth during polishing.

FIG. 5 shows temperature measurement data obtained by the infrared temperature sensor 25 in the course of the polishing. Time $t_0$ is a starting point of polishing. As is understood from FIG. 5, the temperature of the polishing cloth 14 rises up to about 46° C. ($T_A$) due to the frictional heat and the heat produced by the chemical reaction between the W film and the polishing liquid. The temperature is then stabilized at this level. At time $t_1$ the temperature falls steeply, and at time $t_2$ the temperature reaches about 3° C. ($T_B$). The temperature is then kept at this level.

The relationship between the temperature measurement data shown in FIG. 5 and the surface condition of the wafer 15 will now be considered. In this embodiment, use is made of the polishing liquid, which has a greater selectivity of a polishing rate on the W film than on the silicon oxide film, i.e. a polishing liquid which hardly reacts with the silicon oxide film but greatly reacts with the W film. Thus, while the W film is being polished, the polishing liquid is heated by friction and a chemical reaction occurs between the constituents of the polishing liquid and W. It is considered, therefore, that the temperature of the polishing cloth 14 increases due to the heat of the constituents of the polishing liquid and W.

It is then considered that the variation in temperature will continue in the following manner. When the TiN film is polished after the W film is polished away, the amount of reaction heat is less than that of reaction heat produced during the polishing of the W film. In addition, since the FiN film is very thin, the temperature falls stepwise, as seen from the graph of FIG. 5 (i.e. a shoulder portion appears in the graph). In addition, if the TiN film is polished away and the silicon oxide film is exposed, no chemical reaction or substantially no chemical reaction occurs. Thus, the heat is caused only by the friction and the temperature falls, and the temperature is stabilized at this level.

Accordingly, when the end-point of polishing is determined, a temperature slightly higher than $T_B$, e.g. by 5° C., is used as the set temperature. When the detected temperature falls down to the set temperature or below, the end-point of polishing is determined. The set temperature may be decided by conducting experiments in advance, i.e. by raising and moving the wafer holding member 16 apart from the polishing cloth 14 at a certain temperature and confirming that the silicon oxide film is completely exposed at this temperature. In order to determine the end-point of polishing, it is possible to obtain a differential value of the detected temperature and determine, on the basis of the differential value, the time point at which the temperature falls and becomes stable as the end-point of polishing.

In the actual polishing process for the wafer 15, the set temperature thus obtained is stored in a memory, and the surface temperature of the polishing cloth 14 is measured by the infrared temperature sensor 25 while polishing the wafer 15. When the detected temperature falls to the set temperature or below, the end-point detection unit 26 generates an end-point detection signal. Specifically, when the detected temperature falls to the set temperature or below after it was confirmed that the sensed temperature once rose to, e.g. $T_A$, the end-point detection unit 26 issues the end-point detection signal. When the end-point detection signal is input to the control unit 27, the controller 27 outputs a command to raise the vertical drive mechanism 22 and a command to stop the motor 18. Thereby, the wafer 15 is separated from the polishing cloth 14 and the rotation of the polishing cloth 14 is stopped.

After the W film and the TiN film were polished, as described above, the surface of the wafer 15 was observed. It was found that the silicon oxide film was completely exposed and was not excessively polished and that the end-point of polishing was detected with high precision.

As has been described above, according to the first aspect of the present invention, the end-point of polishing can be determined easily and exactly and the polishing work is simplified.

(Embodiment 2)

Figure 6:
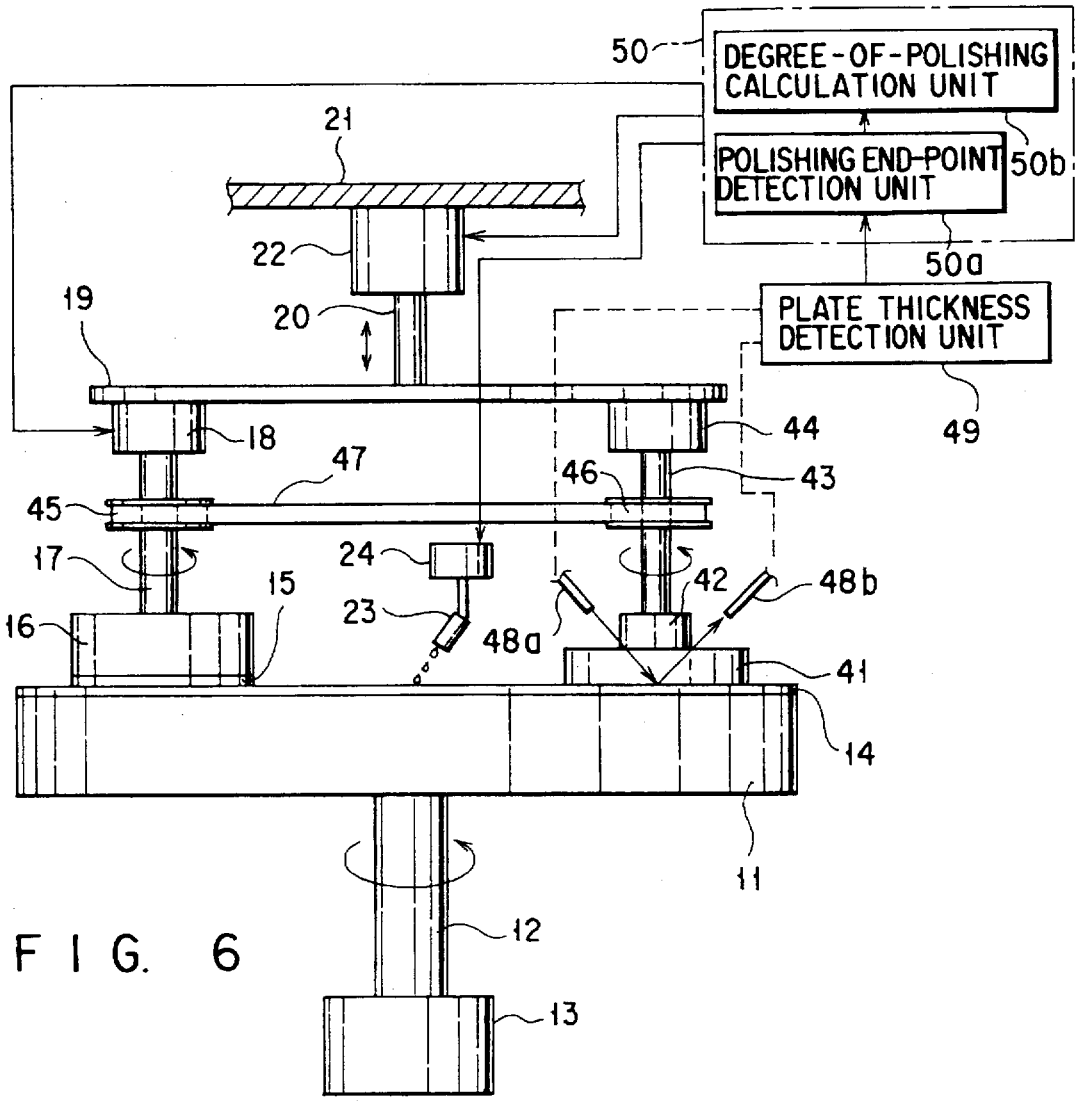
FIG. 6 shows the structure of a polishing apparatus according to a second aspect of the invention.
Figure 7:
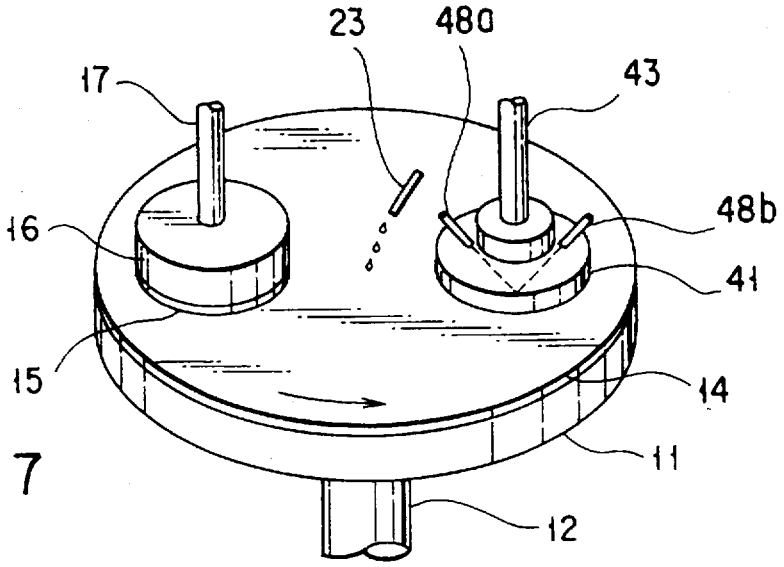
FIG. 7 shows a main part of the polishing apparatus according to the second aspect of the invention.

FIG. 6 shows the structure of a polishing apparatus according to a second aspect of the present invention, and FIG. 7 is a perspective view showing a main part of this polishing apparatus. In FIGS. 6 and 7, the parts common to those in FIG. 2 are denoted by like reference numerals.

In the polishing apparatus shown in FIGS. 6 and 7, a disk holding member 42 is situated symmetrical to a wafer holding member 16 with respect to the center of a rotary tale 11. The disk holding member 42 holds a glass disk 41 serving as reference object-to-be-polished, such that the surface-to-be-polished of the glass disk 41 faces a polishing cloth 14 substantially in parallel. The disk holding member 42 has a vacuum chuck mechanism (not shown) for holding the glass disk 41. One end portion of a rotary shaft 43 is attached to the upper surface of the disk holding member 42, and the other end portion of thereof is attached to a bearing 44.

The bearing 44, like a motor 18, is attached to a vertical drive member 19. The vertical drive member 19 is raised by a vertical drive mechanism 22 by means of a vertical drive shaft 20, thereby to press and separate the glass disk 41 on and from the polishing cloth 14. At this time, the contact pressure acting between the glass disk 41 and polishing cloth 14 is substantially equal to that acting between the wafer 15 and polishing cloth 14.

A pulley 45 is attached to a wafer-side rotary shaft 17 and a pulley 46 is attached to a disk-side rotary shaft 43. A belt 47 is passed between the pulleys 45 and 46. Thereby, a torque of the rotary shaft 17 rotated by the motor 18 is transmitted to the rotary shaft 43 via the pulleys and belt 47. The disk holding member 42 is thus rotated. Accordingly, the wafer holding member 16 and disk holding member 42 are rotated at substantially equal speeds.

A pair of optical fibers **48*a* and 48*b* for radiating light on the glass disk 41 to detect the thickness of the glass disk 41 are situated near the disk holding member 42. The optical fibers 48*a* and 48*b* are connected to a disk thickness detection unit 49. Light emitted from the disk thickness detection unit 49, e.g. a laser beam, is guided through the optical fiber 48*a* for light emission and passed through the glass disk 41. The light is then reflected by the surface of the polishing cloth 14 and received by the optical fiber 48*b* for light reception. The optical fibers 48*a* and 48*b* and the disk thickness detection unit 49 constitute a disk thickness detection apparatus called "ellipsometer." The ellipsometer is fixed on, e.g. a fixed plate 21** by means of a fixing member (not shown). Besides, a proper reference object may be chosen in accordance with the means for detecting the disk thickness.

The disk thickness detection unit 49 is connected to a control unit 50. The control unit 50 comprises a degree-of-polishing calculation unit **50*a* and a polishing end-point detection unit 50*b*. The degree-of-polishing calculation unit 50*a* calculates a degree-of-polishing on the basis of disk thickness detection information delivered from the disk thickness detection unit 49. The polishing end-point detection unit 50*b* detects an end-point of polishing on the basis of degree-of-polishing information delivered from the degree-of-polishing calculation unit 50*a* and a preset value. In this embodiment, the optical fibers 48*a* and 48*b*, disk thickness detection unit 49 and control unit 50** constitute a degree-of-polishing monitoring unit.

The control unit 50 has functions of controlling the driving of the motor 18 and vertical movement mechanism 22 and controlling the supply/stop of the polishing liquid from the polishing liquid supply source 24. When the polishing end-point detection unit **50*b* has detected the end-point of polishing, the control unit 50 stops the motor 18 and supplies a signal to the vertical drive mechanism 22 to raise the wafer holding member 16**.

Figure 8:
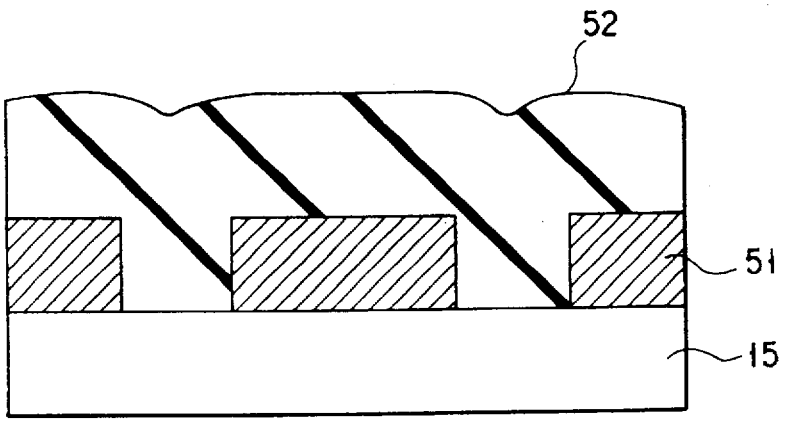
FIG. 8 is a cross-sectional view showing an object-to-polished for use in the polishing method according to the second aspect of the invention.

A description will now be given of a method of polishing an object including a wafer and an interlayer insulating film formed of a silicon oxide film, by means of CMP by using the polishing apparatus having the above structure. FIG. 8 shows the object to be polished. A metallic film with grooves, e.g. an Al film 51, is formed on a wafer 15, and an interlayer insulating film or a silicon oxide film 52 is formed on the entire surface of the Al film 51.

The object having the above structure is mounted on the polishing apparatus and the polishing process is performed in the following manner. At first, the wafer holding member 16 is raised to a high position by the vertical drive mechanism 22, and the wafer 15 having a size of, e.g. 6 inches, is vacuum-attached to the wafer holding member 16 such that the surface-to-be-polished of the wafer 15 faces downward to the polishing cloth 14. At the same time, a circular glass disk 41 having a size of, e.g. 6 inches, which is used as reference object-to-be-polished, is vacuum-attached to the disk holding member 42.

Then, the wafer holding 16 and disk holding member 42 are lowered while the wafer holding member 16 and disk holding member 42 are being synchronously rotated at a rotational speed of 40 rpm and the rotary table 11 is being rotated at a rotational speed of 20 rpm. Thus, the wafer 15 and the glass disk 41 are put in surface-contact with the polishing cloth 14 under a predetermined pressure exerted, for example, by an air pressure of an air cylinder of the vertical drive mechanism 22. At this time, the wafer 15 and glass disk 41 rotate about their own axes and revolve relative to the rotary table 11. The polishing liquid is supplied to the surface of the polishing cloth 14 from the polishing liquid supply nozzle 23. The silicon oxide film 52 of the wafer 15 is polished by the friction among the silicon oxide film 52, polishing cloth 14 and polishing liquid, the chemical reaction between the constituents of the polishing liquid and silicon oxide film 52 due to the frictional heat.

Figure 9:
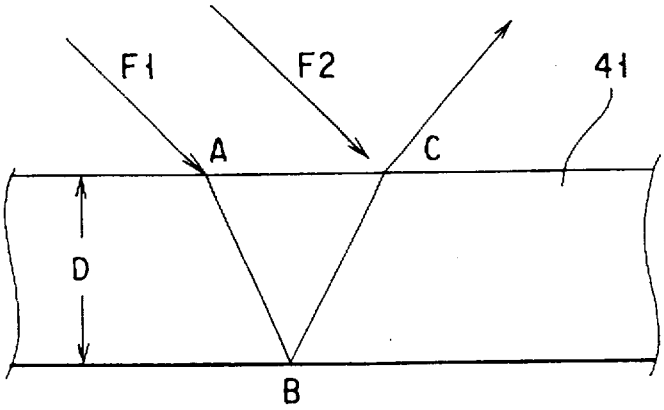
FIG. 9 is an explanatory view illustrating the detection of the amount of polishing of a glass disk used as a reference object-to-be-polished (hereinafter referred to as "reference object").

In addition, the glass disk 41 situated substantially symmetrical to the wafer holding member 16 with respect to the center of the rotary table 11 is rotated in interlock with the wafer 15, the glass disk 41 is similarly polished. The thickness of the glass disk 41 is detected in real time by the disk thickness detection unit 49. Specifically, a light component F1 emitted from the optical fiber 48*a* is refracted at a point A of the glass disk 41, as shown in FIG. 9, travels through the glass disk 41, and is reflected at a point B on the lower surface of the glass disk 41. The reflected light component F1 is then refracted at a point C, emanates from the glass disk 41, and is received by the optical fiber 48*b*. On the other hand, a light component F2 emitted from the optical fiber 48*a* is reflected at the point C. Thus, a phase difference occurs between the light components F1 and F2 in accordance with a thickness D of the glass disk 41. Accordingly, by detecting the phase difference, the thickness of the glass disk 41 can be found. The degree-of-polishing calculation unit 50*a* receives the detected value of disk thickness from the disk thickness detection unit 49 and compares it with the initial value of disk thickness at the time of start of polishing, thereby monitoring the degree-of-polishing in real time.

In the method of this embodiment, the degree-of-polishing of the insulating film (silicon oxide film) can be detected by another technique. That is, a wafer similar to the wafer to be processed is polished in advance by the above-described polishing apparatus and the degree-of-polishing of the glass disk 41 is detected. In addition, the degree-of-polishing of the insulating film on the surface of the wafer is measured. Data on the relationship between both degrees-of-polishing is stored as a parameter in a memory. When the wafer to be processed is actually polished, the degree-of-polishing of the insulating film can be detected on the basis of the degree-of-polishing of the glass disk 41 and the stored parameter. Specifically, the end-point detection unit 49 stores the parameter and a set value of the degree-of-polishing, detects the degree-of-polishing of the insulating film on the basis of the degree-of-polishing of the glass disk 41 and the parameter, and outputs an end-point detection signal when the degree-of-polishing has reached the set value. When the end-point detection signal is output, the control unit 50 produces control signals to raise the wafer holding member 16 and stop the motor 18.

According to the second embodiment, the glass disk 41 is used as reference object to be polished, and the thickness of the glass disk 41 is optically detected to find the degree-of-polishing thereof. Based on the found degree-of-polishing, the degree-of-polishing of the wafer 15 is detected. Thus, the degree-of-polishing of the object can be monitored in real time on the order of several Å. By determining the end-point of polishing on the basis of the detected degree-of-polishing. Accordingly, even if the surface condition of the polishing cloth 14 varies, for example, even if the polishing cloth 14 is worn and the polishing rate varies, the degree-of-polishing can be controlled with high precision and the object can be polished exactly. Besides, if the degree-of-polishing in a predetermined time period is less than a predetermined value (i.e. if the time needed to attain a predetermined degree-of-polishing is more than a predetermined value), the degradation of the polishing cloth 14 is determined and the end-point of polishing is detected. Thereby, the apparatus of this embodiment can be used as a life monitor of the polishing cloth. Furthermore, by observing scattering of reflection light, the surface roughness, scratches, etc. of the polishing cloth can be detected.

The apparatus according to the second embodiment is applicable to the polishing of a film other than the silicon oxide film, e.g. a silicon nitride film. Besides, this apparatus is applicable to the step of polishing the object having the film structure as shown in FIG. 4A (i.e. the step of exposing the silicon oxide film 32 in FIG. 4A). In this case, the degree-of-polishing of the W film 35 is monitored and after it has reached a degree-of-polishing corresponding to the thickness of the W film 35, the finish of polishing is delayed by a time (a very short time) needed to polish away the TiN film 34 which is, e.g. a barrier layer. Thus, the apparatus of the second embodiment is applicable to the step of polishing a single film by a predetermined degree, and to the step of polishing away one of laminated different films.

As has been described above, according to the second embodiment of the invention, when the surface of an object, e.g. a wafer is polished, the degree-of-polishing of the object can be monitored by previously finding the relationship between the degree-of-polishing of the object and that of the reference object. Therefore, the degree-of-polishing can be controlled with high precision and the polishing is effected exactly.

The first and second embodiments may be combined on an as-needed basis.

The present invention is not limited to the above embodiments and various modifications can be made without departing from the spirit of the invention. For example, in this invention, when the end-point of polishing is determined, torque current monitoring means may be combined in addition to the means for sensing he temperature of the polishing cloth and the means for monitoring the degree-of-polishing of the reference object. Thereby, the end-point of polishing can be determined more exactly. Furthermore, in the above embodiments, the colloidal silica is used as polishing liquid, but the polishing liquid may include $CeO_2$.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of polishing an object by CMP with use of a polishing liquid, said object including a first layer and a second layer of a material different from the material of the first layer, said method comprising the steps of:

detecting a change point of the temperature of a surface-to-be-polished of the first layer while said first layer is being polished, on the basis of an information unit on the temperature of the surface-to-be-polished of the first layer and an information unit on the temperature of a surface-to-be-polished of the second layer, which information units are obtained by polishing in advance said first and second layers; and detecting an end point of the polishing of the first layer on the basis of information on the change point.

2. The method according to claim 1, wherein said first layer is an electrically conductive film and said layer is an insulating film.

3. The method according to claim 2, wherein said electrically conductive film is at least one selected from among the group consisting of a W film, an Al film, a Cu film, and a polysilicon film, and said insulating film is at least one selected from among the group consisting of a silicon oxide film, and a silicon nitride film.

4. The method according to claim 1, wherein said first layer is an insulating film and said second layer is an electrically conductive film.

5. The method according to claim 4, wherein said insulating film is at least one selected from among the group consisting of a silicon oxide film, and a silicon nitride film, and said electrically conductive film is at least one selected from among the group consisting of a W film, an Al film, a Cu film, and a polysilicon.

6. The method according to claim 4, wherein said polishing liquid has a greater selectivity of a polishing rate on said first layer than on said second layer.

7. The method according to claim 1, wherein a barrier layer is interposed between the first layer and the second layer.

8. The method according to claim 1, wherein the second layer of said object has grooves, and the ratio of a pitch of said grooves to a width of each of the grooves is 2 or more.

9. The method according to claim 1, wherein the change point of the temperature of the surface-to-be-polished of the first layer is detected by an infrared temperature sensor while said first layer is being polished.

10. An apparatus for polishing an object by CMP with use of a polishing liquid, while relatively rotating a surface-to-be-polished of the object and a polishing surface of a polishing body, with both surfaces-to-be-polished being put in contact, said object including a first layer and a second layer of a material different from the material of the first layer, said apparatus comprising:

temperature detection means for detecting the temperature of the surface-to-be-polished of the object; and end point detection means for detecting the end point of polishing of the first layer on the basis of a predetermined set value and the detected temperature detected by said temperature detection means.

11. The apparatus according to claim 10, wherein said first layer is an electrically conductive film and said layer is an insulating film.

12. The apparatus according to claim 11, wherein said electrically conductive film is at least one selected from among the group consisting of a W film, an Al film, a Cu film, and a polysilicon film, and said insulating film is at least one selected from among the group consisting of a silicon oxide film, and a silicon nitride film.

13. The apparatus according to claim 10, wherein said first layer is an insulating film and said second layer is an electrically conductive film.

14. The apparatus according to claim 13, wherein said insulating film is at least one selected from among the group consisting of a silicon oxide film, and a silicon nitride film, and said electrically conductive film is at least one selected from among the group consisting of a W film, an Al film, a Cu film, and a polysilicon film.

15. The apparatus according to claim 13, wherein said polishing liquid has a greater selectivity of a polishing rate on said first layer than on said second layer.

16. The apparatus according to claim 10, wherein a barrier layer is interposed between the first layer and the second layer.

17. The apparatus according to claim 10, wherein the second layer of said object has grooves, and the ratio of a pitch of said grooves to a width of each of the grooves is 2 or more.

* * * * *